US009392890B1

(12) United States Patent
Royak

(10) Patent No.: US 9,392,890 B1
(45) Date of Patent: Jul. 19, 2016

(54) HANGER AND METHOD

(71) Applicant: Jodie Royak, Santee, CA (US)

(72) Inventor: Jodie Royak, Santee, CA (US)

( * ) Notice: Subject to any disclaimer, the term of this patent is extended or adjusted under 35 U.S.C. 154(b) by 0 days.

(21) Appl. No.: 14/943,458

(22) Filed: Nov. 17, 2015

Related U.S. Application Data

(63) Continuation-in-part of application No. 14/717,199, filed on May 20, 2015.

(60) Provisional application No. 62/171,834, filed on Jun. 5, 2015.

(51) Int. Cl.
*A47G 1/16* (2006.01)
*A47G 1/20* (2006.01)
*B25H 7/04* (2006.01)

(52) U.S. Cl.
CPC . *A47G 1/16* (2013.01); *A47G 1/205* (2013.01); *B25H 7/04* (2013.01)

(58) Field of Classification Search
CPC ..... A47G 1/16; A47G 1/205; A47G 1/20; A47G 1/1633; A47G 1/1606; B25H 7/04; Y10T 24/32
See application file for complete search history.

(56) References Cited

U.S. PATENT DOCUMENTS

| | | | | |
|---|---|---|---|---|
| D235,308 | S | 6/1975 | Clark | |
| 4,040,149 | A | 8/1977 | Einhorn | |
| 5,398,906 | A | 3/1995 | Aydelott | |
| 5,867,917 | A | 2/1999 | Karon | |
| 6,186,466 | B1 | 2/2001 | Baird et al. | |
| 7,441,741 | B2 | 10/2008 | Wong | |
| 8,371,543 | B2 | 2/2013 | Schneider | |
| 8,632,044 | B2 | 1/2014 | Cave | |
| 8,740,171 | B2 | 6/2014 | Crescenzo | |
| 2005/0006554 | A1 | 1/2005 | DeLine | |
| 2006/0231721 | A1 | 10/2006 | Robic | |
| 2012/0151811 | A1 | 6/2012 | Ivall | |
| 2013/0232840 | A1 * | 9/2013 | Miller | A47G 1/162 40/757 |

* cited by examiner

*Primary Examiner* — David Bryant
*Assistant Examiner* — Lee A Holly
(74) *Attorney, Agent, or Firm* — Procopio Cory Hargreaves and Savitch LLP

(57) ABSTRACT

A method of using a hanger and marking device includes holding an article adjacent to the wall and determining the exact desired location on the wall for hanging the article; exerting pressure on the article so as to cause a support marker of the device to create a small indent in the wall at the desired location; temporarily anchoring the article to the wall with the support marker; stepping back from the wall and observing the temporarily anchored article on the wall; removing the article from the wall; nailing the nail into the wall at the location marked by the device; hanging the article on the wall by mounting the device with picture onto the wall-mounted nail; exerting pressure on the article so as to cause the support marker of the device to anchor into the wall while the device with article is mounted onto the wall-mounted nail.

11 Claims, 7 Drawing Sheets

HANGER AND METHOD

CROSS REFERENCE TO RELATED APPLICATIONS

This application is a continuation-in-part of U.S. Nonprovisional patent application Ser. No. 14/717,199 filed May 20, 2015 and claims priority to U.S. Provisional Patent Application No. 62/171,834 filed Jun. 5, 2015, both of which are incorporated by reference herein.

FIELD OF THE INVENTION

The present invention relates in general to picture hangers, and, in particular to combination picture hanger and wall-marking devices for marking on a wall the desired location for the installation of a nail or other support for hanging a picture.

BACKGROUND OF THE INVENTION

Pictures typically include a hanger bracket on a rear side and near a top of the picture for hanging the picture on a wall-mounted nail. Because the hanger bracket is on a rear side of the picture, determining where a nail needs to be mounted on a wall for the desired picture location is challenging, and often involves a trial-and-error process. Either one has to settle with the picture located not quite at the desired location and/or is left with numerous unsightly extra holes in the wall from the trial-and-error process.

U.S. Pat. No. 5,398,906 proposes a wall-marking device that is releasably attachable to a suspension element on the article to be hanged. The attached wall-marking device is used to mark a desired location for placing a nail in the wall. This wall-marking device and/or separation of a wall-marking device from a frame hanger creates multiple issues. First, separation of a wall-marking device from a frame hanger causes the burden of having to attach and detach the wall-marking device to/from the frame hanger not designed to receive this wall-marking device before/after marking the desired location for placing a nail on the wall. Also, since all frames and hangers have different sizes and shapes it is difficult to create a single marking device that would easily attach to various hangers. Although U.S. Pat. No. 5,398,906 proposes a variety of forms and shapes to fit different frames and hangers, it doesn't offer any universal solution. Further, the wall-marking device has to be temporarily attached to the frame or hanger in order to be used, creating an issue of accuracy. A marker that is not permanently attached to a hanger will likely move once a person hanging a picture will put some pressure on it in his or her efforts to identify the best location for a piece of art or other object. That lack of fixation is a potential source of inaccuracy in marking. Moreover, the proposed variety of models (rather than one universal solution) makes it difficult to manufacture and use by those groups of people that it was thought for.

SUMMARY OF THE INVENTION

An aspect of the invention involves a one-piece hanger and marking device for an article to be hung on a wall (e.g., picture, mirror, artwork, arts and crafts, or other article to be hung on a wall) using a wall-mounted nail or support. The device is bracket-shaped and includes flanges with holes at opposite ends for mounting the device via fasteners to a rear of the article to be hung on a wall. The device includes a rear with a support marker for marking a location for placing a nail on the wall. Below the support marker is support receiving recess that receives the nail for mounting the device and article to be hung on a wall on the wall-mounted nail. The device includes angled bottom edges that ride along the wall-mounted nail to guide the support receiving recess onto the wall-mounted nail.

In use, with the device mounted on the top rear of the article to be hung on a wall, a person holds the article to be hung on a wall adjacent to the wall and determines the exact desired location for hanging the article to be hung on a wall. When the desired wall location is determined, pressure exerted on article to be hung on a wall causes the support marker of the device to create a small indent in the wall at the desired location. The article to be hung on a wall is removed from the wall and a nail or other support is nailed into the wall at the location marked by the device. The article to be hung on a wall is then placed against the wall with the device above the wall-mounted nail, and the article to be hung on a wall with device is let down onto the wall-mounted nail, the angled bottom edges riding along the wall-mounted nail to guide the support receiving recess onto the wall-mounted nail so that the article to be hung on a wall and device are mounted to the exact desired location for hanging the article to be hung on a wall.

Another aspect of the invention involves a one-piece hanger and marking device for an article to be hung on a wall comprising flange sections with holes at opposite ends for mounting the one-piece hanger and marking device via fasteners to a rear of the article to be hung on a wall; a central section bridging the flange sections, the central section include a front surface and a rear surface; and a support marker protruding from the rear surface of the central section for marking a location for mounting a nail on a wall for mounting the article to be hung on a wall.

One or more implementations of the aspect of the invention described immediately above include one or more of the following: the central section includes a support receiving recess below the support marker that receives the nail for mounting the device and article to be hung on a wall on the wall-mounted nail; and/or the central section includes a top edge and angled bottom edges that ride along the wall-mounted nail to guide the support receiving recess onto the wall-mounted nail.

A further aspect of the invention involves a method of using the one-piece hanger and marking device described for hanging an article to be hung on a wall. The method includes holding the article to be hung on a wall adjacent to the wall and determining the exact desired location on the wall for hanging the article to be hung on a wall; exerting pressure on the article to be hung on a wall so as to cause the support marker of the device to create a small indent in the wall at the desired location; removing the article to be hung on a wall from the wall; nailing the nail into the wall at the location marked by the one-piece hanger and marking device; and hanging the article to be hung on a wall on the wall by mounting the one-piece hanger and marking device with article to be hung on a wall onto the wall-mounted nail.

In an implementation of the aspect of the invention described immediately above, the central section includes a support receiving recess below the support marker that receives the nail for mounting the device and article to be hung on a wall on the wall-mounted nail, the central section includes a top edge and angled bottom edges that ride along the wall-mounted nail to guide the support receiving recess onto the wall-mounted nail, and hanging the article to be hung on a wall on the wall includes lowering the article to be hung on a wall so that at least one of the angled bottom edges of the one-piece hanger and marking device contacts the wall-mounted nail and ride along the wall-mounted nail to guide the support receiving recess onto the wall-mounted nail so that the article to be hung on a wall and one-piece hanger and marking device are mounted to the exact desired location for hanging the article to be hung on a wall.

Another aspect of the invention involves a method of using a hanger and marking device for hanging an article to be hung on a wall, the device comprising a mount to attach the device to a rear of the article, a support marker section including a front surface and a rear surface; a support marker protruding from the rear surface of the support marker section for marking a location for mounting a nail on a wall for mounting the article. The method comprises: holding the article adjacent to the wall and determining the exact desired location on the wall for hanging the article; exerting pressure on the article so as to cause the support marker of the device to create a small indent in the wall at the desired location; temporarily anchoring the article to the wall with the support marker of the device; stepping back from the wall and observing the temporarily anchored article on the wall; removing the article from the wall; nailing the nail into the wall at the location marked by the device; hanging the article on the wall by mounting the device with picture onto the wall-mounted nail; exerting pressure on the article so as to cause the support marker of the device to anchor into the wall while the device with article is mounted onto the wall-mounted nail.

One or more implementations of the aspect of the invention described immediately above include one or more of the following: the support marker section includes a support receiving recess below the support marker that receives the nail for mounting the device and article on the wall-mounted nail; the support marker section includes a top edge and angled bottom edges that ride along the wall-mounted nail to guide the support receiving recess onto the wall-mounted nail; the one-piece hanger and marking device includes a central section with the support marker section; the central section includes opposite sides and the mount includes a pair of flange sections coupled to the central section on the opposite sides; each of the pair of flange sections includes a hole for receiving a fastener to mount the device to the article; the mount includes a flange section coupled to the central section above the central section; the flange section is a semi-circular flange section; and/or the flange section includes a hole for receiving a fastener to mount the device to the article.

A further aspect of the invention involves a method of using a hanger and marking device for hanging an article to be hung on a wall, the device comprising a mount to attach the device to a rear of the article, a support marker section including a front surface and a rear surface; a support marker protruding from the rear surface of the support marker section for marking a location for mounting a nail on a wall for mounting the article. The method comprises: holding the article adjacent to the wall and determining the exact desired location on the wall for hanging the article; exerting pressure on the article so as to cause the support marker of the device to create a small indent in the wall at the desired location; temporarily anchoring the article to the wall with the support marker of the device; stepping back from the wall and observing the temporarily anchored article on the wall; removing the article from the wall; nailing the nail into the wall at the location marked by the device; hanging the article on the wall by mounting the device with picture onto the wall-mounted nail.

One or more implementations of the aspect of the invention described immediately above include one or more of the following: the support marker section includes a support receiving recess below the support marker that receives the nail for mounting the device and article on the wall-mounted nail; the support marker section includes a top edge and angled bottom edges that ride along the wall-mounted nail to guide the support receiving recess onto the wall-mounted nail; the one-piece hanger and marking device includes a central section with the support marker section; the central section includes opposite sides and the mount includes a pair of flange sections coupled to the central section on the opposite sides; each of the pair of flange sections includes a hole for receiving a fastener to mount the device to the article; the mount includes a flange section coupled to the central section above the central section; the flange section is a semi-circular flange section; and/or the flange section includes a hole for receiving a fastener to mount the device to the article.

A still further aspect of the invention involves a method of using a hanger and marking device for hanging an article to be hung on a wall, the device comprising a mount to attach the device to a rear of the article, a support marker section including a front surface and a rear surface; a support marker protruding from the rear surface of the support marker section for marking a location for mounting a nail on a wall for mounting the article. The method comprises: holding the article adjacent to the wall and determining the exact desired location on the wall for hanging the article; exerting pressure on the article so as to cause the support marker of the device to create a small indent in the wall at the desired location; removing the article from the wall; nailing the nail into the wall at the location marked by the device; hanging the article on the wall by mounting the device with picture onto the wall-mounted nail; exerting pressure on the article so as to cause the support marker of the device to anchor into the wall while the device with article is mounted onto the wall-mounted nail.

One or more implementations of the aspect of the invention described immediately above include one or more of the following: the support marker section includes a support receiving recess below the support marker that receives the nail for mounting the device and article on the wall-mounted nail; the support marker section includes a top edge and angled bottom edges that ride along the wall-mounted nail to guide the support receiving recess onto the wall-mounted nail; the one-piece hanger and marking device includes a central section with the support marker section; the central section includes opposite sides and the mount includes a pair of flange sections coupled to the central section on the opposite sides; each of the pair of flange sections includes a hole for receiving a fastener to mount the device to the article; the mount includes a flange section coupled to the central section above the central section; the flange section is a semi-circular flange section; and/or the flange section includes a hole for receiving a fastener to mount the device to the article.

DESCRIPTION OF EMBODIMENTS OF THE INVENTION

The accompanying drawings, which are incorporated in and form a part of this specification illustrate embodiments of the invention and together with the description, serve to explain the principles of the invention.

DETAILED DESCRIPTION

Figure 1:
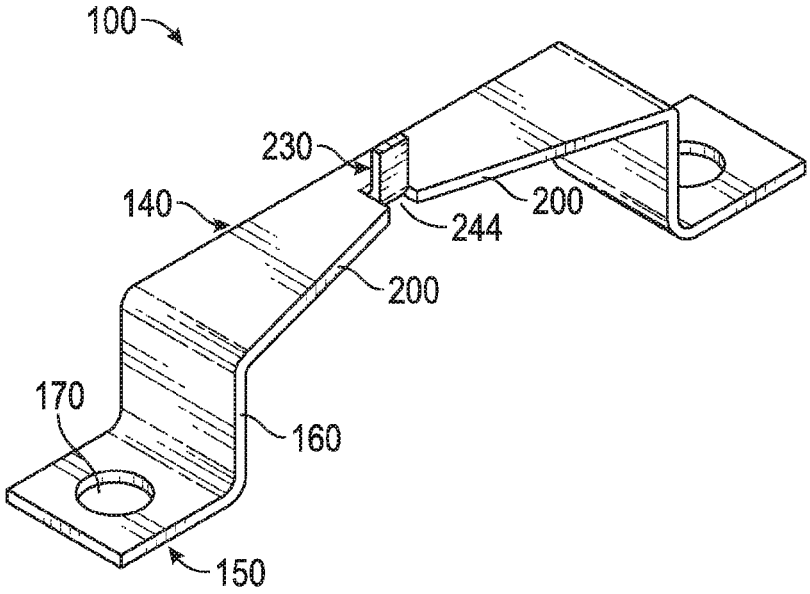
FIG. 1 is a perspective view of an embodiment of a one-piece hanger and marking device.
Figure 2:
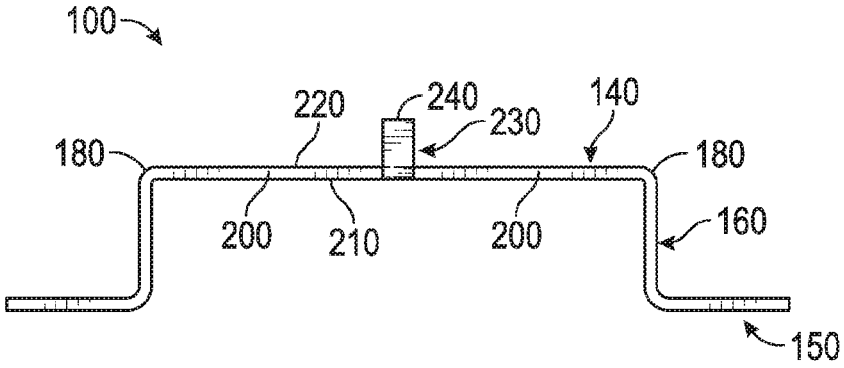
FIG. 2 is a front elevational view of the one-piece hanger and marking device of FIG. 1.
Figure 3:
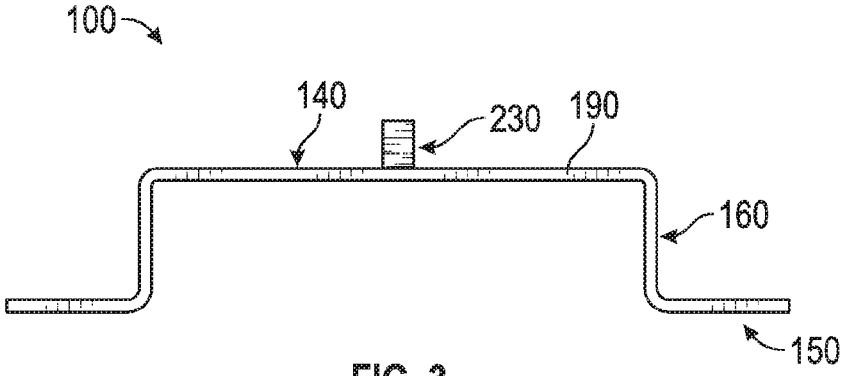
FIG. 3 is a rear elevational view of the one-piece hanger and marking device of FIG. 1.
Figure 4:
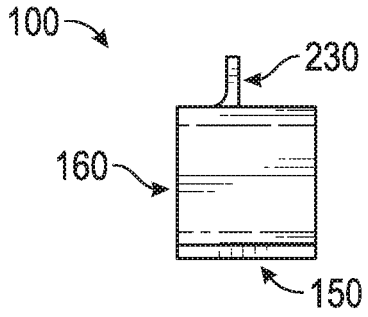
FIG. 4 is a left elevational view of the one-piece hanger and marking device of FIG. 1.
Figure 5:
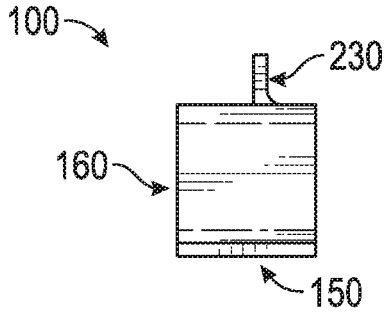
FIG. 5 is a right elevational view of the one-piece hanger and marking device of FIG. 1.
Figure 6:
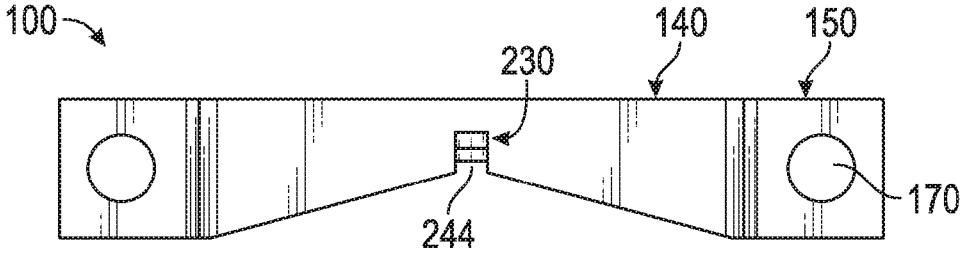
FIG. 6 is a top plan view of the one-piece hanger and marking device of FIG. 1.
Figure 7:
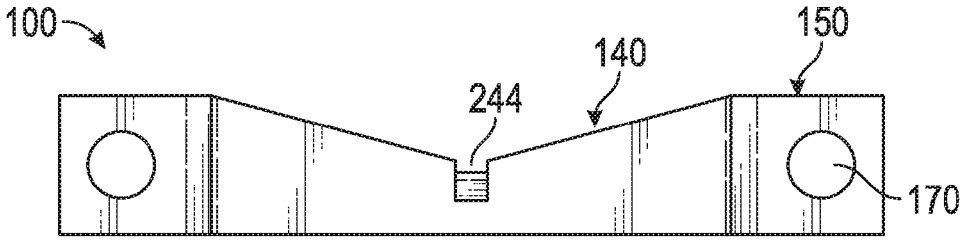
FIG. 7 is a bottom plan view of the one-piece hanger and marking device of FIG. 1.

With reference to FIGS. 1-11, and initially FIGS. 1-7, an embodiment of a one-piece hanger and marking device ("device") 100 for a picture frame 250 and picture 110 to be hung on a wall 120 (hereinafter "picture 110" or "article to be hung on a wall" or "article") using a wall-mounted nail 130 will be described. Although the device 100 will be described in conjunction with a picture 110, the device 100 may be used with any article to be hung on a wall (e.g., picture, mirror, artwork, arts and crafts, or other article to be hung on a wall). Further, although the device 100 will be described in conjunction with a wall-mounted nail 130, the device 100 may be used with other wall-mounted supports and hangers. As used herein, wall-mounted nail means a wall-mounted nail or other support/hanger that utilizes a wall-mounted nail for mounting the support/hanger to the wall. Further, as used herein, wall refers to any substantially vertical support surface that pictures, mirrors or other articles may be hung on or supported from.

The device 100 has a bracket shape and includes a central section or support marker section 140 parallel with and connected to opposite coplanar flange sections 150 via connecting sections 160 that extend ninety degrees relative to the central section 140 and flange sections 150. The flange sections 150 include holes 170 that receive fasteners (e.g., screws) for mounting the device 100 to a top rear of the picture 110.

The central section 140 includes opposite ends 180, top edge 190, angled bottom edges 200, front surface 210, and rear surface 220. A support marker or marker 230 protrudes rearwardly from the rear surface 220. Although the marker 230 is shown as a rectangular tab that terminates in a substantially flat end 240, in alternative embodiments, the marker 230 may be pointed, sharp-tipped, or have another configuration for marking a small depression in the wall 120 at the desired location. In further embodiments, the marker 230 is adapted to mark the wall with graphite, ink, or other pigmented marking material. Directly beneath the marker 230 in the central section 140 is a support receiving recess 240 that receives the wall-mounted nail 130 for mounting the device 100 and picture 110 on the wall-mounted nail 130. The angled bottom edges 200 ride along the wall-mounted nail 130 to guide the support receiving recess 240 onto the wall-mounted nail 130. The angled bottom edges 200 are angled downwardly, progressing from the support receiving recess 240 to the opposite ends 180.

Figure 12:
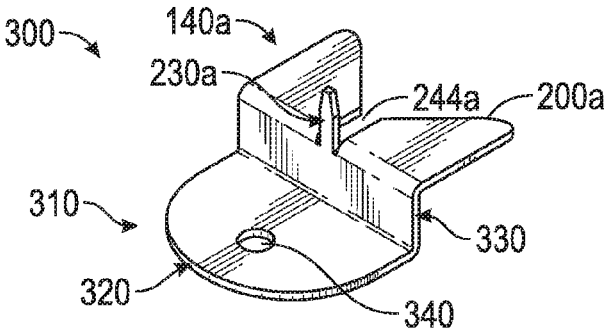
FIG. 12 is a perspective view of another embodiment of a one-piece hanger and marking device.

With reference to FIG. 12, another embodiment of a one-piece hanger and marking device ("device") 300 will be described. Similar features in device 300 to device 100 will be shown with like reference numbers, but with an "a" suffix and will not be described. The description of these similar features above is incorporated by reference herein. The device 300 is similar to the device 100, except instead of the mount (s) being on opposite sides of central section 140, mount or flange section 310 coupled to and above central section **140*a*. Substantially semi-circular flange section 320 is parallel with central section 140*a* and connected to central section 140*a* via connecting section 330, which extends ninety degrees relative to the central section 140*a* and flange section 320. The flange section 320 includes hole 340 that receives a fasteners (e.g., screw) for mounting the device 300 to a top rear of the picture 110. The angled bottom edges 200** terminate in curved tips.

With reference to FIGS. 8-11 and 13, the device 100/300 will now be described in use.

Figure 8:
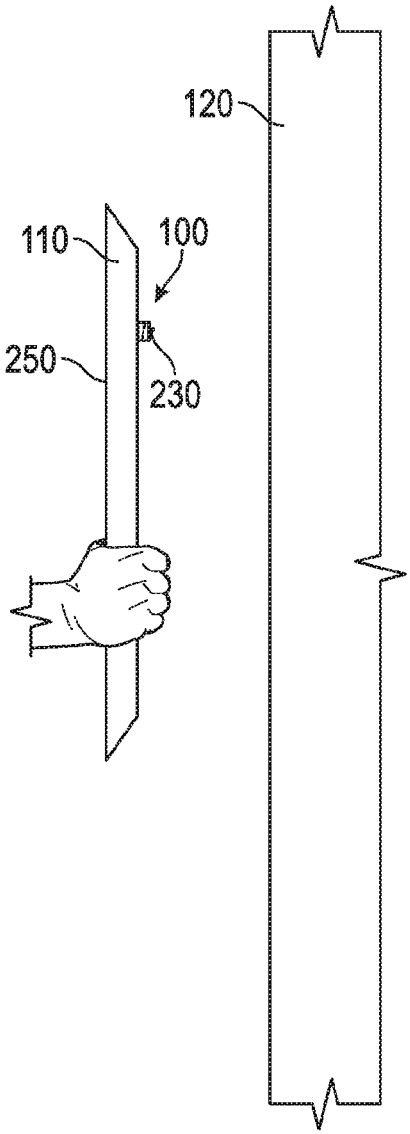
FIG. 8 is a right side elevational view of the one-piece hanger and marking device on a picture and shows the picture being held adjacent to the wall and positioned to an exact desired location for hanging the picture.
Figure 13:
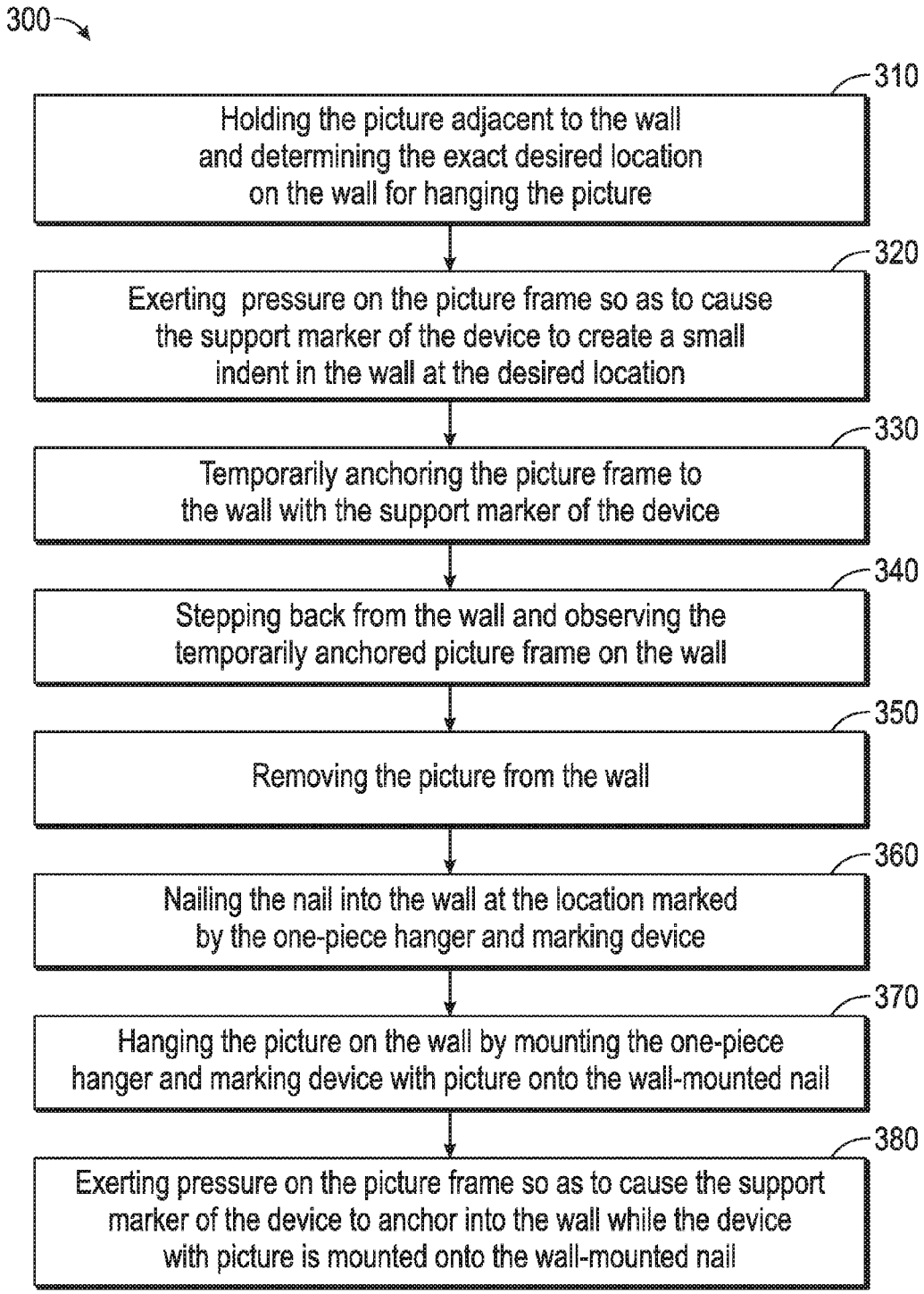
FIG. 13 is a flow chart showing an exemplary method of hanging a picture frame with the device.

As shown in FIG. 8 and in step 310 of FIG. 13, with the device 100/300 mounted on the top rear of the picture or article 110, a user holds the picture 110 adjacent to the wall 120 and determines the exact desired location for hanging the picture 110.

Figure 9A:
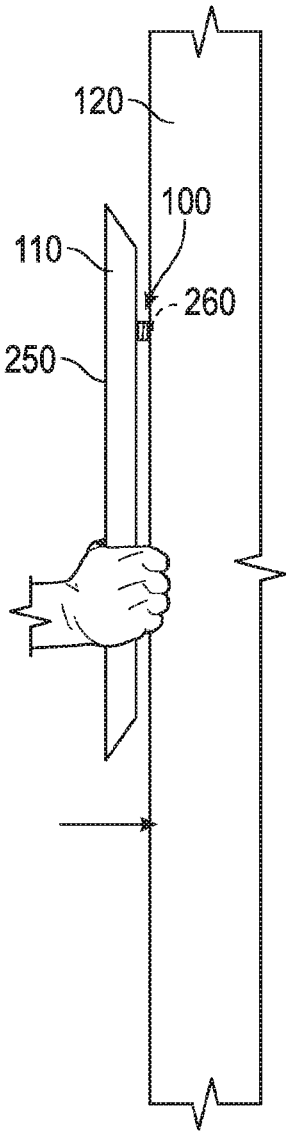
FIG. 9A is a right side elevational view, similar to FIG. 8, and shows the picture at the exact desired location and pressure exerted on a picture frame causing the support marker of the device to create a small indent in the wall at the desired location.

As shown in FIG. 9A and in step 320 of FIG. 13, when the desired wall location is determined, pressure exerted on picture frame 250 in the direction of the arrow causes the support marker 230 of the device 100/300 to create a small indent 260 in the wall 120 at the desired location.

Figure 9B:
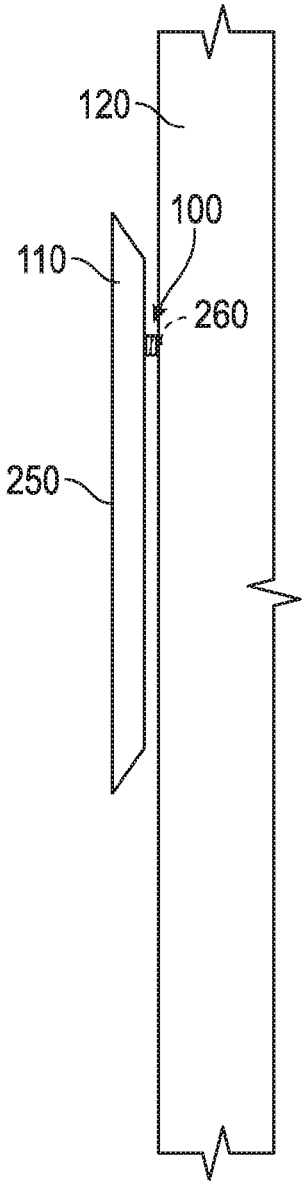
FIG. 9B is a right side elevational view, similar to FIG. 8, and shows temporarily anchoring the picture frame to the wall with the support marker of the device.

As shown in FIG. 9B and in step 330 of FIG. 13, the picture frame 250 is temporarily anchored to the wall 120 with the support marker 230 of the device 100/300.

Figure 9C:
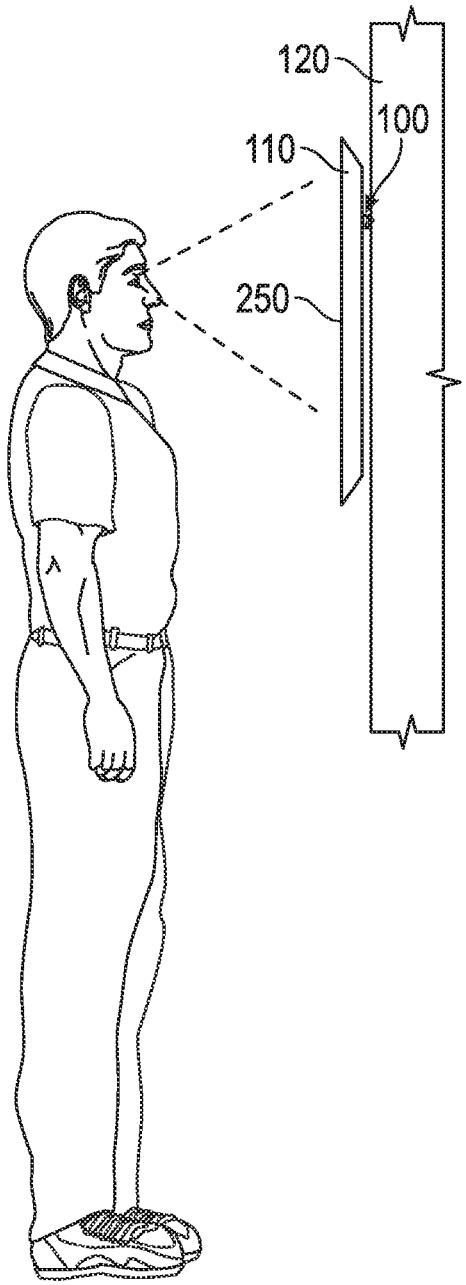
FIG. 9C is a right side elevational view and shows a user stepping back from the wall and observing the temporarily anchored picture frame on the wall.

As shown in FIG. 9C and in step 340 of FIG. 13, a user steps back from the wall and observes the temporarily anchored picture frame 250 on the wall 120.

Figure 10A:
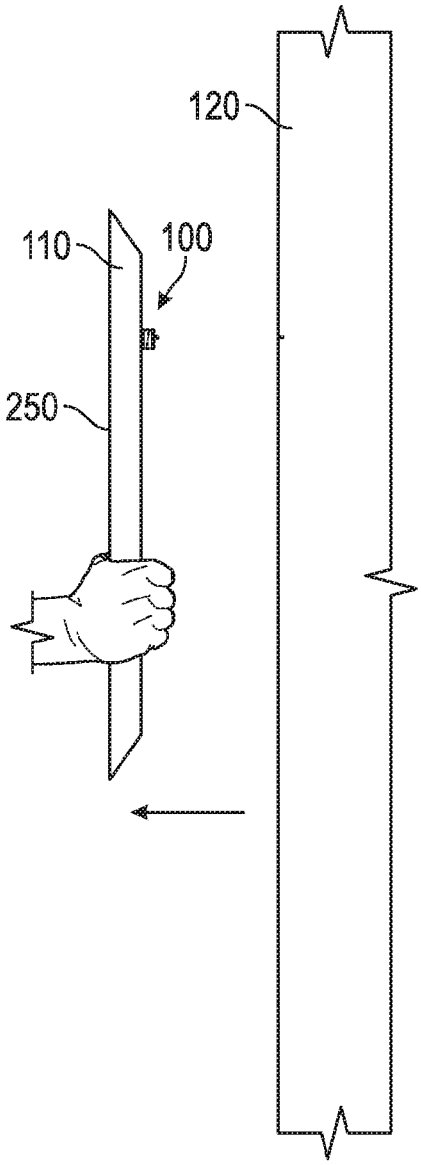
FIG. 10A is a right side elevational view, similar to FIG. 8, and shows the picture being removed from the wall.

As shown in FIG. 10A and in step 350 of FIG. 13, the picture 110 is removed from the wall 120.

Figure 10B:
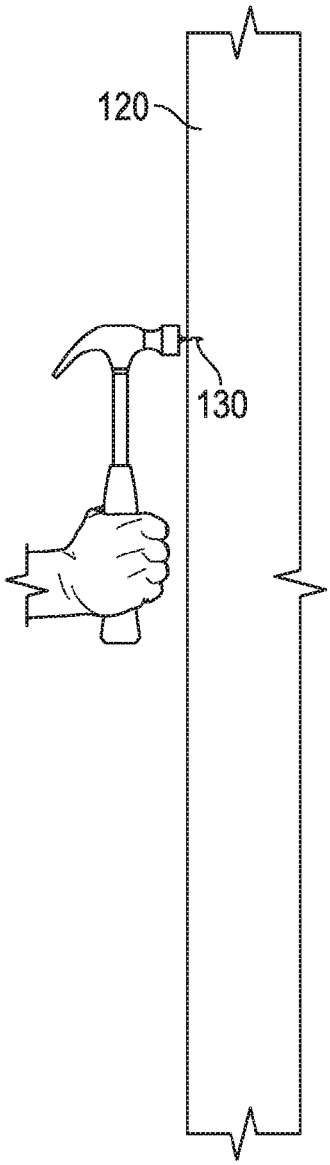
FIG. 10B is a right side elevational view, similar to FIG. 8, and shows hammering a nail into the wall at the location marked by the device.

As shown in FIG. 10B and in step 360 of FIG. 13, the nail 120 or other support is hammered/nailed into the wall 120 at the location marked by the device 100/300.

Figure 10C:
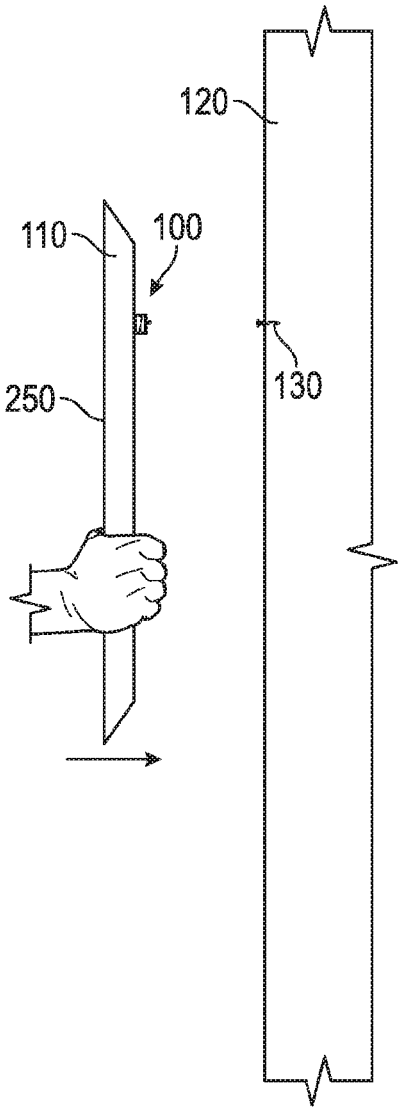
FIG. 10C is a right side elevational view, similar to FIG. 8, and shows hanging the picture on the wall by mounting the one-piece hanger and marking device with picture onto the wall-mounted nail.

As shown in FIG. 10C and in the step 370 of FIG. 13, the picture frame 250/picture 110 is hanged on the wall 120 by mounting the one-piece hanger and marking device 100/300 with picture 110 onto the wall-mounted nail 120. The picture 110 is placed against the wall 120 with the device 100/300 above the wall-mounted nail 130, and the picture 110 with device 100/300 is let down onto the wall-mounted nail 130, the angled bottom edges 200 riding along the wall-mounted nail 130 to guide the support receiving recess 240 onto the wall-mounted nail 130 so that the picture 110 and device 100/300 are mounted to the exact desired location for hanging the picture 110.

Figure 11:
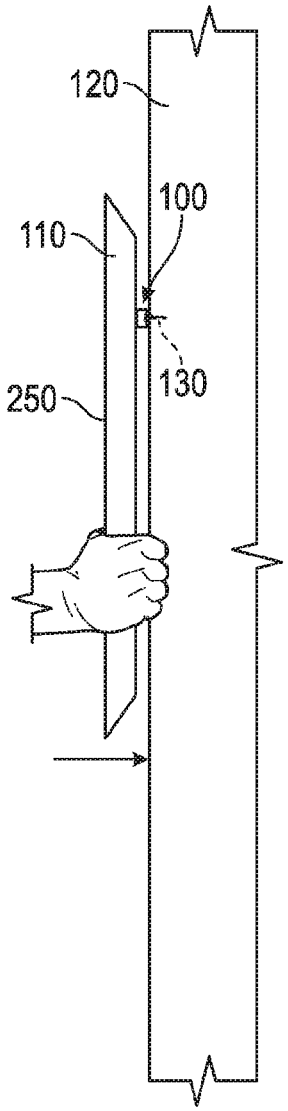
FIG. 11 is a right side elevational view, similar to FIG. 8, and shows exerting pressure on the picture frame so as to cause the support marker of the device to anchor into the wall while the device with picture is mounted onto the wall-mounted nail.

As shown in FIG. 11 and in the step 380 of FIG. 13, pressure is exerted on the picture frame 250 so as to cause the support marker 230 of the device 100/300 to anchor into the wall 120 while the device 100/300 with picture 110 is mounted onto the wall-mounted nail 130.

In one or more alternative methods of the method of using the hanger and marking device 100/300 described above, one or more of the above-recited steps are not included and/or one more steps not described are added. For example, but not by way of limitation, an alternative method of using the hanger and marking device 100/300 includes steps 310 through 370 recited above, but does not include step 380, exerting pressure on the picture frame 250 so as to cause the support marker 230 of the device 100/300 to anchor into the wall 120 while the device 100/300 with picture 110 is mounted onto the wall-mounted nail 130. Another alternative method of using the hanger and marking device 100/300 includes steps 310, 320, and 350-380, but does not include steps 330 and 340, temporarily anchoring the picture frame 250 to the wall 120 with the support marker 230 of the device 100/300 and stepping back from the wall and observing the temporarily anchored picture frame 250 on the wall 120.

Advantages of the device 100/300 over U.S. Pat. No. 5,398,906 include at least the following:

1. Versatility over variety: The device 100/300 offers a universal solution that would work with any frame, while U.S. Pat. No. 5,398,906 device attempts to find different solutions that would work for different frames and hangers. Since all the frames and hangers have different sizes and shapes it is difficult to create a single marking device that would fit all of them. Although U.S. Pat. No. 5,398,906 proposes a variety of embodiments, forms and shapes to fit different frames and hangers, it doesn't offer any universal solution. The invention involving a one-piece handing and marketing device solves this inconvenience.

2. Unity over separation of elements: The device 100/300 is based on unity of two elements: a hanger and a marker, that are fixed together to create a simple and accurate marking tool. A marker that is not permanently attached to a hanger will move once a person hanging a picture will put some pressure on it (in his or her efforts to identify the best location for a piece of art or any other objects). That lack of fixation is a potential source of inaccuracy in marking. While U.S. Pat. No. 5,398,906 offers multiple ways to attach a marking device to a hanger to reach the most accurate marking result, the device 100/300 is based on the unity of those two which guaranties the most accurate result.

3. Simplicity over complexity: The device 100/300 is very simple and can be easily produced and easily used by people for whom this device was invented. At the same time U.S. Pat. No. 5,398,906 (in its attempt to fit variety of frames and hangers) is more complex and comes in multiple variations, forms and shapes which makes it significantly more difficult to produce and use by people for marking.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A method of using a hanger and marking device for hanging an article to be hung on a wall, the device comprising a mount to attach the device to a rear of the article, a support marker section including a front surface and a rear surface; a support marker protruding from the rear surface of the support marker section for marking a location for mounting a nail on a wall for mounting the article, the method comprising:

holding the article adjacent to the wall and determining the exact desired location on the wall for hanging the article;

exerting pressure on the article so as to cause the support marker of the device to create a small indent in the wall at the desired location;

temporarily anchoring the article to the wall with the support marker of the device;

stepping back from the wall and observing the temporarily anchored article on the wall;

removing the article from the wall;

nailing the nail into the wall at the location marked by the device;

hanging the article on the wall by mounting the device with picture onto the wall-mounted nail;

exerting pressure on the article so as to cause the support marker of the device to anchor into the wall while the device with article is mounted onto the wall-mounted nail.

2. A method of using a hanger and marking device for hanging an article to be hung on a wall, the device comprising a mount to attach the device to a rear of the article, a support marker section including a front surface and a rear surface; a support marker protruding from the rear surface of the support marker section for marking a location for mounting a nail on a wall for mounting the article, the method comprising:

holding the article adjacent to the wall and determining the exact desired location on the wall for hanging the article;

exerting pressure on the article so as to cause the support marker of the device to create a small indent in the wall at the desired location;

temporarily anchoring the article to the wall with the support marker of the device;

stepping back from the wall and observing the temporarily anchored article on the wall;

removing the article from the wall;

nailing the nail into the wall at the location marked by the device;

hanging the article on the wall by mounting the device with picture onto the wall-mounted nail.

3. A method of using a hanger and marking device for hanging an article to be hung on a wall, the device comprising a mount to attach the device to a rear of the article, a support marker section including a front surface and a rear surface; a support marker protruding from the rear surface of the support marker section for marking a location for mounting a nail on a wall for mounting the article, the method comprising:

holding the article adjacent to the wall and determining the exact desired location on the wall for hanging the article;

exerting pressure on the article so as to cause the support marker of the device to create a small indent in the wall at the desired location;

removing the article from the wall;

nailing the nail into the wall at the location marked by the device;

hanging the article on the wall by mounting the device with picture onto the wall-mounted nail;

exerting pressure on the article so as to cause the support marker of the device to anchor into the wall while the device with article is mounted onto the wall-mounted nail.

4. The method of claim 1, wherein the support marker section includes a support receiving recess below the support marker that receives the nail for mounting the device and article on the wall-mounted nail.

5. The method of claim 4, wherein the support marker section includes a top edge and angled bottom edges that ride along the wall-mounted nail to guide the support receiving recess onto the wall-mounted nail.

6. The method of claim 5, wherein the one-piece hanger and marking device includes a central section with the support marker section.

7. The method of claim 6, wherein the central section includes opposite sides and the mount includes a pair of flange sections coupled to the central section on the opposite sides.

8. The method of claim 7, wherein each of the pair of flange sections includes a hole for receiving a fastener to mount the device to the article.

9. The method of claim 6, wherein the mount includes a flange section coupled to the central section above the central section.

10. The method of claim 9, wherein the flange section is a semi-circular flange section.

11. The method of claim 10, wherein the flange section includes a hole for receiving a fastener to mount the device to the article.

* * * * *